US007186171B2

(12) United States Patent
Oh et al.

(10) Patent No.: US 7,186,171 B2
(45) Date of Patent: Mar. 6, 2007

(54) COMPOSITE RETAINING RING

(75) Inventors: Jeonghoon Oh, Sunnyvale, CA (US); Hung Chih Chen, Sunnyvale, CA (US); Thomas B. Brezoczky, San Jose, CA (US); Douglas R. McAllister, Pleasanton, CA (US); David Datong Huo, Campell, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/407,695

(22) Filed: Apr. 19, 2006

(65) Prior Publication Data

US 2006/0240750 A1 Oct. 26, 2006

Related U.S. Application Data

(60) Provisional application No. 60/674,211, filed on Apr. 22, 2005.

(51) Int. Cl.
*B24B 29/00* (2006.01)

(52) U.S. Cl. ..... 451/285; 451/287; 451/290; 451/398

(58) Field of Classification Search ..... 451/41, 451/285, 287, 288, 290, 397, 398, 402, 286
See application file for complete search history.

(56) References Cited

U.S. PATENT DOCUMENTS

| | | | | |
|---|---|---|---|---|
| 5,738,574 | A | 4/1998 | Tolles et al. | |
| 6,835,125 | B1 * | 12/2004 | Tseng et al. | 451/398 |
| 6,974,371 | B2 * | 12/2005 | Chen et al. | 451/398 |
| 7,033,252 | B2 * | 4/2006 | Fuhriman et al. | 451/41 |
| 7,094,139 | B2 * | 8/2006 | Marohl et al. | 451/442 |
| 2002/0164939 | A1 * | 11/2002 | Kuo et al. | 451/443 |
| 2005/0113002 | A1 * | 5/2005 | Chen et al. | 451/42 |
| 2005/0211377 | A1 | 9/2005 | Chen et al. | |
| 2005/0215182 | A1 * | 9/2005 | Fuhriman et al. | 451/41 |
| 2005/0266783 | A1 * | 12/2005 | Taylor | 451/388 |

* cited by examiner

*Primary Examiner*—Eileen P. Morgan
(74) *Attorney, Agent, or Firm*—Fish & Richardson

(57) ABSTRACT

A two part retaining ring is described that has a lower ring and an upper ring. The lower ring contacts a polishing surface during chemical mechanical polishing. The upper surface and the lower surface of the lower ring have matching grooves formed therein to increase the flexibility of the lower ring.

14 Claims, 7 Drawing Sheets

COMPOSITE RETAINING RING

CROSS-REFERENCE TO RELATED APPLICATIONS

This application claims the benefit of priority of U.S. Provisional Application Ser. No. 60/674,211, filed Apr. 22, 2005. The disclosure of the prior application is considered part of and is incorporated by reference in the disclosure of this application.

BACKGROUND

This invention relates to a retaining ring for use in chemical mechanical polishing.

An integrated circuit is typically formed on a substrate by the sequential deposition of conductive, semiconductive or insulative layers on a silicon substrate. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head of a CMP apparatus. The exposed surface of the substrate is placed against a rotating polishing disk pad or belt pad. The polishing pad can be either a standard pad or a fixed-abrasive pad. A standard pad has a durable roughened surface, whereas a fixed-abrasive pad has abrasive particles held in a containment media. The carrier head provides a controllable load on the substrate to push it against the polishing pad. The carrier head has a retaining ring which holds the substrate in place during polishing. A polishing slurry, including at least one chemically-reactive agent, and abrasive particles if a standard pad is used, is supplied to the surface of the polishing pad.

SUMMARY

A retaining ring formed of two parts, a lower portion and an upper portion, is described. The lower portion, which contacts a polishing surface during polishing of a substrate, has channels or grooves on its lower surface. The lower portion also has channels or grooves on its upper surface. The lower portion and the upper portion form the retaining ring.

In one aspect, the invention is directed to an upper ring having a lower surface and a lower ring with a lower surface and an upper surface, the upper surface adjacent to the lower surface of the upper ring. The lower surface of the lower ring has a plurality of grooves and the upper surface has a plurality of grooves that are substantially vertically overlapping with the plurality of grooves in upper surface.

Implementations of the invention may include one or more of the following features. The grooves in the lower surface and/or the upper surface can extend from an inner diameter of the lower ring to the outer diameter. The location of each groove in the upper surface can correspond to a location of each groove in the lower surface. The grooves can be arc shaped or linear. One edge of each groove can be straight while the opposite edge is curved. The grooves can be other than parallel with a radius of the retaining ring. The thin potion between the grooves can have a width to thickness ratio between about 1:1 and 10:1. The grooves can have a u-shaped cross-section, where the side walls are substantially perpendicular to one another. The lower ring can be formed from carbon-filled PEEK.

In another aspect, the invention is directed to a retaining ring for chemical mechanical polishing of a substrate. The ring has first and second annular portions. The second portion has a plurality of relatively thick subportions and a plurality of relatively thin subportions where top and bottom surfaces of the thin subportions are not co-planar with top and bottom surfaces of the thick subportions.

In another aspect, the invention is directed to a method of forming a retaining ring. A first annular portion is formed having an upper surface with a plurality of upper surface grooves and a lower surface with a plurality of lower surface grooves, and wherein locations of the upper surface grooves in the upper surfaces substantially correspond to locations of the lower surface grooves in the lower surface.

Implementations of the invention may include one or more of the following features. Forming the first annular portion can include machining the upper and lower surface grooves into the first annular portion. A second annular portion can be formed which is secured to the upper surface of the first annular portion, such as with an adhesive. Forming the first annular portion can include injection molding a plastic material.

In yet another aspect, the invention is directed to system for chemically. mechanically polishing a substrate. The system includes a carrier head having a lower substrate backing member and a retaining ring as described herein. The system includes a polishing surface support, wherein the retaining ring is brought near the polishing surface support during substrate polishing.

In another aspect, the invention is directed to a portion of a retaining ring for use in chemical mechanical polishing of a substrate. A ring has an upper surface and a lower surface, wherein the upper surface has a plurality of upper surface grooves and the lower surface has a plurality of lower surface grooves and at least one of the upper surface grooves is substantially vertically overlapping at least one of the lower surface grooves.

In another aspect, the invention is directed to a carrier head having a substrate backing member having a substrate contacting surface and a retaining ring as described herein surrounding the substrate contacting surface.

Implementations of the invention may include one or more of the following advantages. By forming a matching groove on the upper surface of the lower ring to a groove on the lower surface, the narrow region between the grooves may have a higher degree of flexibility than other portions of the lower ring. The narrow regions may increase the overall flexibility of the lower ring so that the lower ring may be more flexible than a ring similarly sized with no grooves or grooves only on the lower surface.

During polishing, relative motion is created between the retaining ring and a polishing surface. This motion may create internal stress in the lower ring. Accumulated internal stress may eventually cause delaminating of the retaining ring. By increasing the ratio of the width to the height of the retaining ring, the internal stress and cupping force within the ring may be reduced. By forming a matching groove on the upper surface of the lower ring, the thickness of a portion of the ring may be further reduced. These grooves may also reduce the internal stress of the retaining ring.

Both reducing the thickness of the lower ring and forming matching grooves in the upper and lower surfaces of the ring may increase the flexibility of the lower ring. The lower ring may have the ability to twist when external stress is placed on the ring. The lower ring may be machined prior to use to form a bottom surface that is orthogonal to the central axis of the retaining ring. When the retaining ring is in use, for example, when a substrate is being polished, or when the retaining ring is being machined, the ring can twist so that any distorting forces or localized stress on the ring is not transferred across the ring, but is only applied to a small portion of the ring. Because the ring is flexible, the ring may bend only in the area of localized stress. Also, when the retaining ring is being machined, the ability of the lower ring to bend or twist may enable the retaining ring to be machined with little to no distortion along the bottom surface.

A retaining ring that prevents internal stress from accumulating may have a longer working life than a conventional retaining ring. Forming the lower ring out of injection molded plastic may increase the likelihood of internal stress building up within the ring during use. When the lower ring is formed, the material can be selected based on a number of factors, such as lifespan, wear resistively, ability to achieve desired flatness during or after molding, propensity for internal stress build-up or ability to reduce imperfections in the ring. However, if the structure of the retaining ring prevents internal stress from building up within the ring during polishing and machining, the selection of the material from which the lower ring is formed need not be based on whether the material is susceptible to internal stress build up, and thus, the retaining ring may be formed form a wider variety of materials.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

A retaining ring 100 is a generally an annular ring that can be secured to a carrier head of a CMP apparatus. A suitable CMP apparatus is described in U.S. Pat. No. 5,738,574 and a suitable carrier head is described in U.S. Publication No. 2005-0211377, filed Mar. 26, 2004, the entire disclosures of which are incorporated herein by reference.

Figure 1:
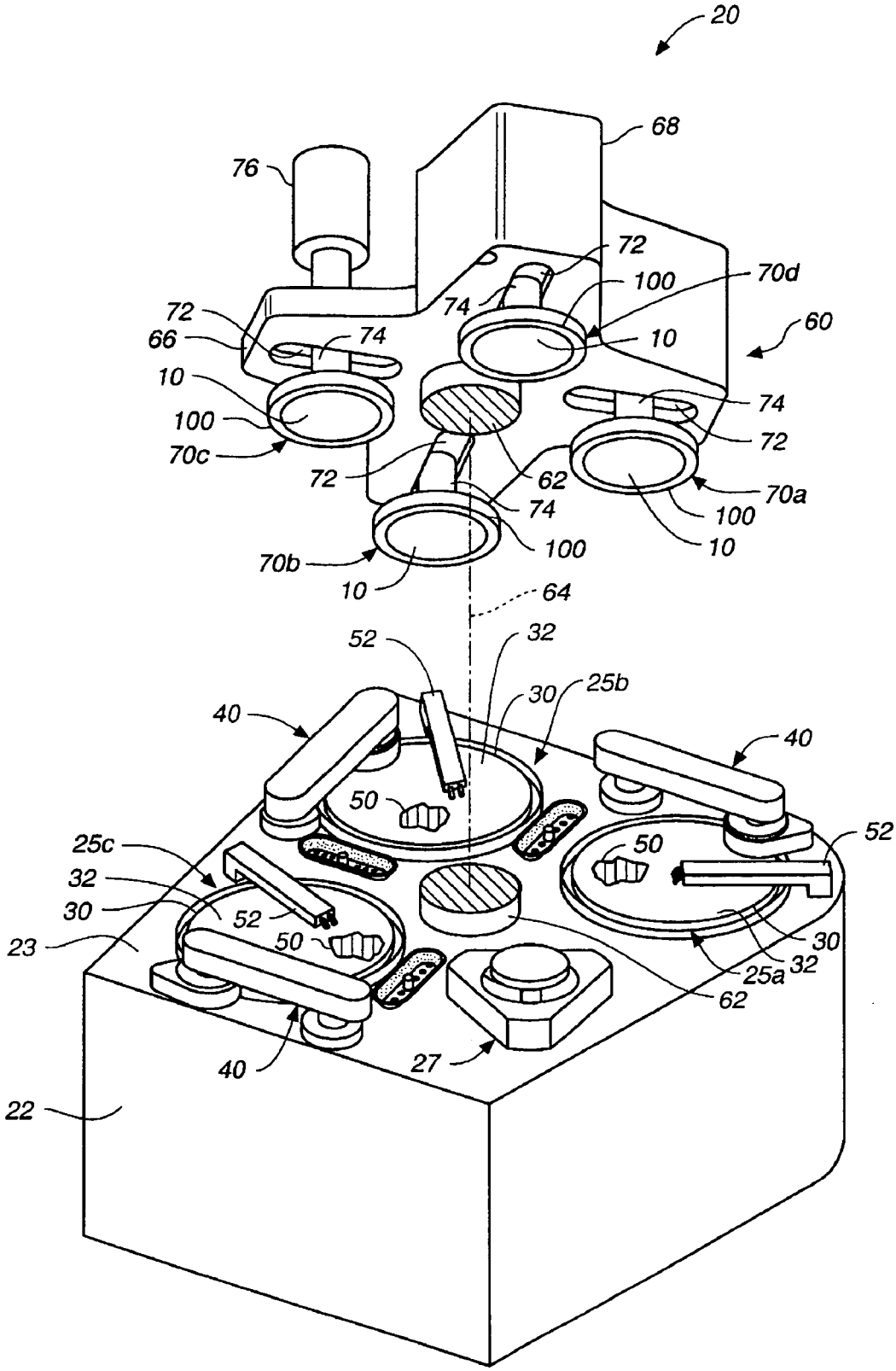
FIG. 1 is an exploded perspective view of a chemical mechanical polishing apparatus.

Referring to FIG. 1, one or more substrates will be polished by a chemical mechanical polishing (CMP) apparatus 20. The substrates are held by a wafer backing member 10.

Each polishing station 25*a*–25*c* includes a rotatable platen 30 on which is placed a polishing pad 32. If substrate is an eight-inch (200 millimeter) or twelve-inch (300 millimeter) diameter disk, then platen 30 and polishing pad 32 will be about twenty or thirty inches in diameter, respectively. Platen 30 may be connected to a platen drive motor (not shown) located inside machine base 22. For most polishing processes, the platen drive motor rotates platen 30 at thirty to two-hundred revolutions per minute, although lower or higher rotational speeds may be used. Each polishing station 25*a*–25*c* may further include an associated pad conditioner apparatus 40 to maintain the abrasive condition of the polishing pad.

A polishing liquid 50 may be supplied to the surface of polishing pad 32 by a combined slurry/rinse arm 52. The polishing liquid 50 may include abrasive particles (e.g., silicon dioxide for oxide polishing). Typically, sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60, including a carousel support plate 66 and a cover 68, is positioned above lower machine base 22. Carousel support plate 66 is supported by a center post 62 and rotated thereon about a carousel axis 64 by a carousel motor assembly located within machine base 22. Multi-head carousel 60 includes four carrier head systems 70*a*, 70*b*, 70*c*, and 70*d* mounted on carousel support plate 66 at equal angular intervals about carousel axis 64. Three of the carrier head systems receive and hold substrates and polish them by pressing them against the polishing pads of polishing stations 25*a*–25*c*. One of the carrier head systems receives a substrate from and delivers the substrate to transfer station 27. The carousel motor may orbit carrier head systems 70*a*–70*d*, and the substrates attached thereto, about carousel axis 64 between the polishing stations and the transfer station.

Each carrier head system 70*a*–70*d* includes a polishing or carrier head. Each carrier head independently rotates about its own axis, and independently laterally oscillates in a radial slot 72 formed in carousel support plate 66. A carrier drive shaft 74 extends through slot 72 to connect a carrier head rotation motor 76 (shown by the removal of one-quarter of cover 68) to carrier head. There is one carrier drive shaft and motor for each head. Each motor and drive shaft may be supported on a slider (not shown) which can be linearly driven along the slot by a radial drive motor to laterally oscillate the carrier head.

During actual polishing, three of the carrier heads, e.g., those of carrier head systems 70*a*–70*c*, are positioned at and above respective polishing stations 25*a*–25*c*. Each carrier head lowers a substrate into contact with a polishing pad 32. Generally, carrier head holds the substrate in position against the polishing pad and distributes a force across the back surface of the substrate. The carrier head also transfers torque from the drive shaft to the substrate.

As shown in FIGS. 2A, 2B and 3–6, a retaining ring 100 is a generally an annular ring that can be secured to a carrier head of the CMP apparatus. The retaining ring holds a substrate within the carrier head during polishing.

Figure 2A:
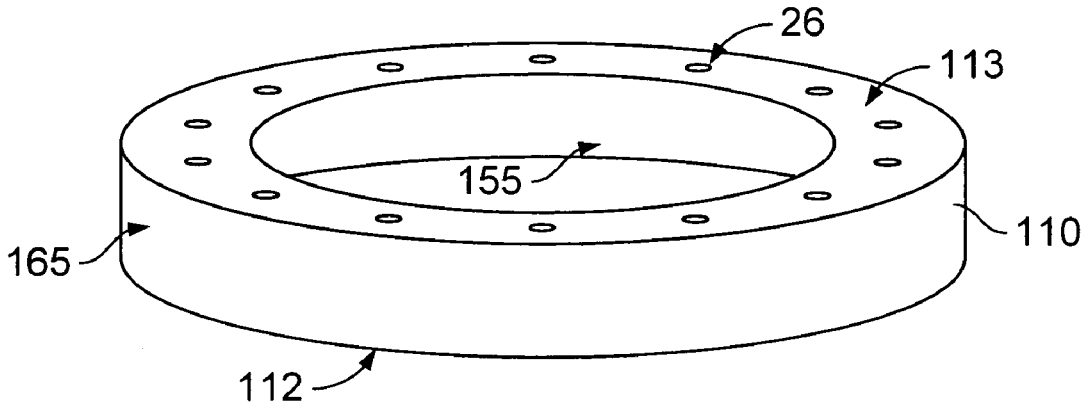
FIGS. 2A and 2B are an exploded perspective view of a two part retaining ring.
Figure 2B:
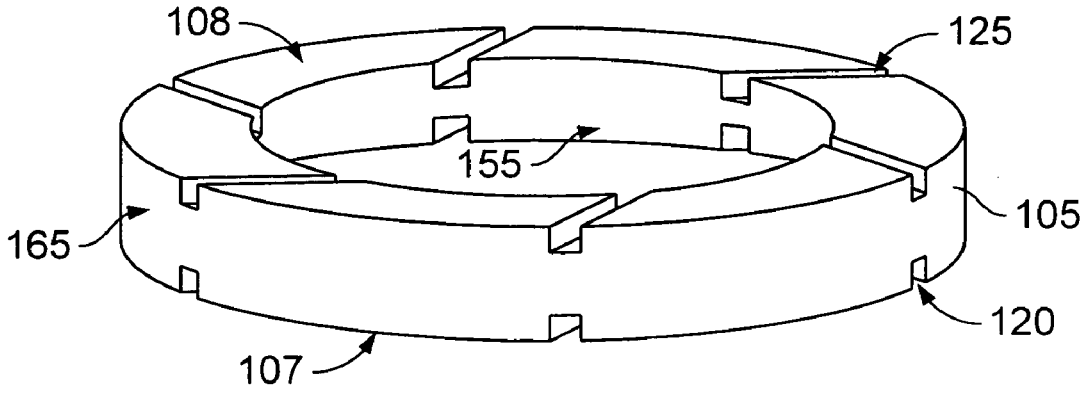
Figure 3:
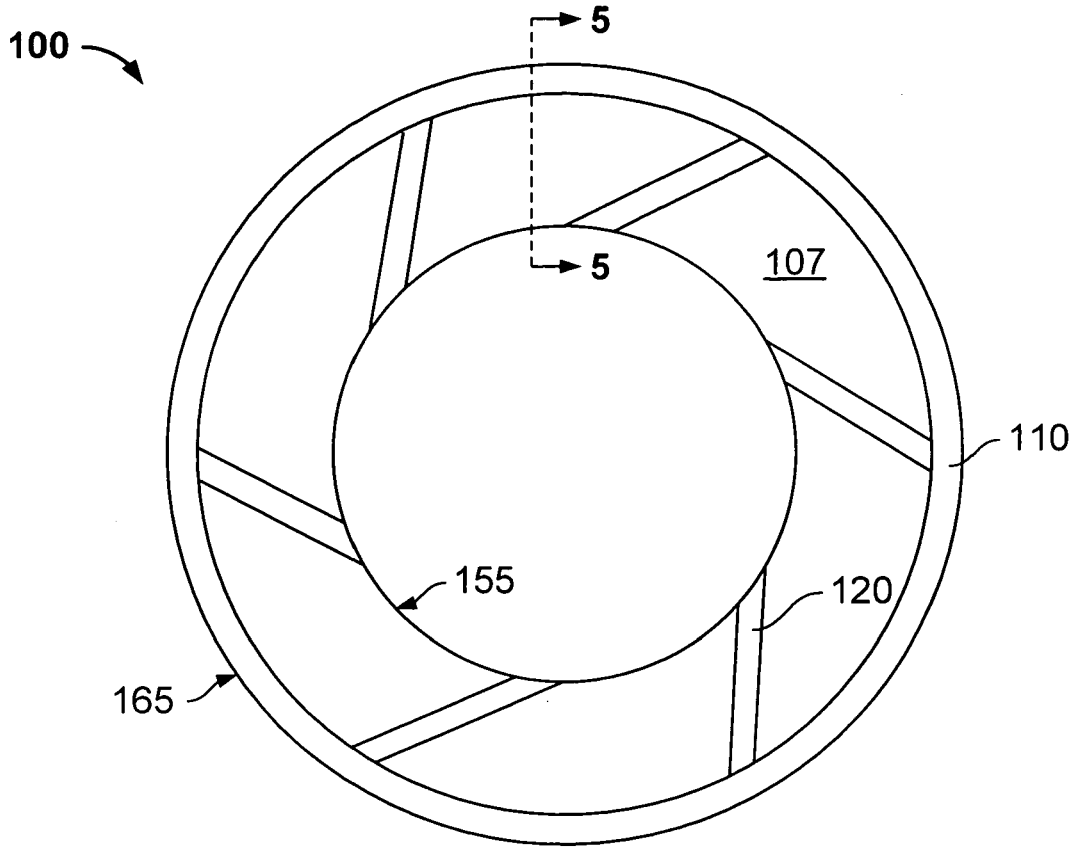
FIG. 3 is a bottom plan view of a composite retaining ring.

The retaining ring 100 can be constructed from two rings, including a lower ring 105 (FIG. 2B) and an upper ring 10 (FIG. 2A). The lower ring 105 has a lower surface 107 that can be brought into contact with a polishing surface, such as a polishing pad, and an upper surface 108. The lower ring 105 can be formed of a material which is chemically inert in a CMP process, such as a thermoplastic or polymer material, including polyphenylene sulfide (PPS), polyetheretherketone (PEEK), carbon-filled PEEK, Teflon® filled PEEK, polyethylene terephthalate (PET), polybutylene terephthalate (PBT), polytetrafluoroethylene (PTFE), polybenzimidazole (PBI), polyetherimide (PEI), polyamide-imide (PAI), or a composite material. The lower ring 105 should also be durable and have a low wear rate. In addition, the lower ring should be sufficiently compressible so that contact of the substrate edge against the retaining ring does not cause the substrate to chip or crack. On the other hand, the lower ring 105 should not be so elastic that downward pressure on the retaining ring causes the lower ring 105 to extrude into the substrate receiving recess. The lower ring 105 has a thickness of about 100 to 500 mils, such as between about 150 and 400 mils. The lower ring 105 has grooves 120, 125 in the upper and lower surfaces 108, 107, which are discussed further herein.

The upper ring 110 of the retaining can be formed of a rigid material, such as a metal, e.g., stainless steel, molybdenum, or aluminum, or a ceramic, e.g., alumina, or other exemplary materials. The upper ring can alternatively be made from plastic that is the same material as the lower ring or a dissimilar material.

The lower and upper rings together form the retaining ring 100. When the two rings are joined, the upper surface 108 of the lower ring 105 is positioned adjacent the lower surface 112 of the upper ring 110. The two rings have substantially the same dimensions at the inner and outer diameters such that portions of the inner 155 and outer diameter 165 surfaces are flush when the two rings are joined.

The top surface 113 of the upper ring 110 generally includes holes 26 with screw sheaths to receive fasteners, such as bolts, screws, or other hardware, for securing the retaining ring 100 to the carrier head. The holes 26 can be evenly spaced around the carrier head. Additionally, one or more alignment features, such as apertures or projections (not shown), can be located on the top surface 113 of the upper ring 110. If the retaining ring has an alignment aperture, the carrier head can have a corresponding pin that mates with the alignment aperture when the carrier head and retaining ring are properly aligned.

Figure 4:
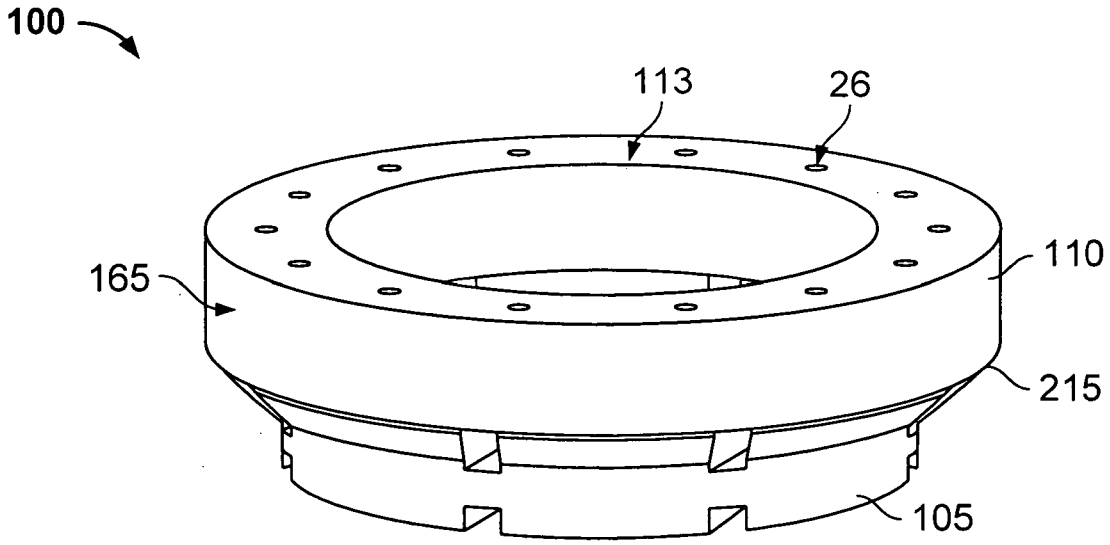
FIG. 4 is a perspective view of a composite retaining ring.
Figure 5:
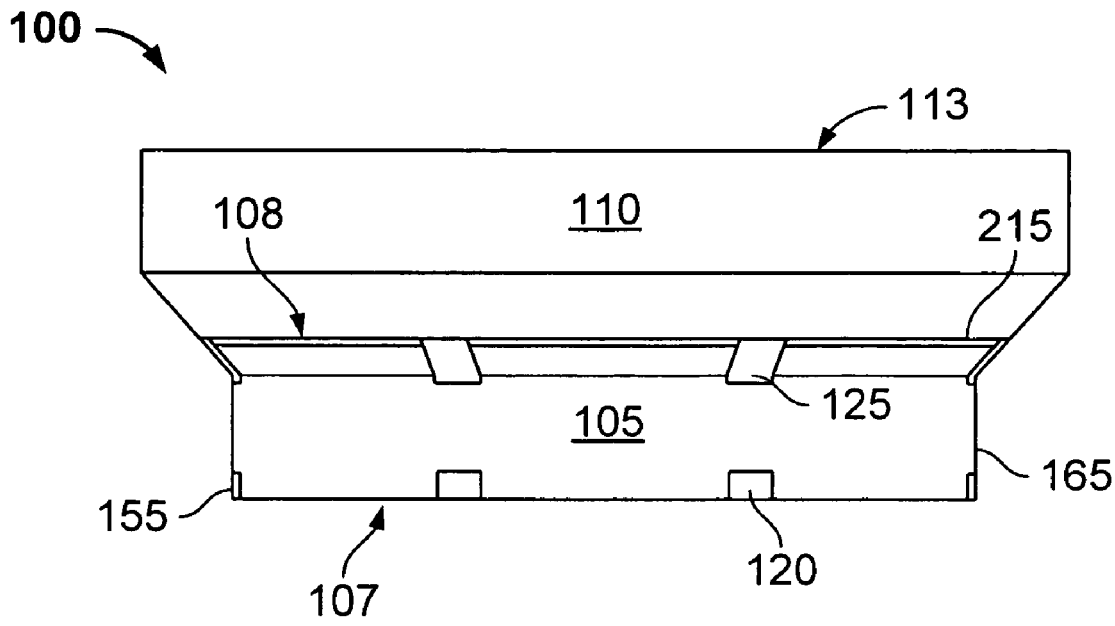
FIG. 5 is a cross-sectional side view of a composite retaining ring.
Figure 6:
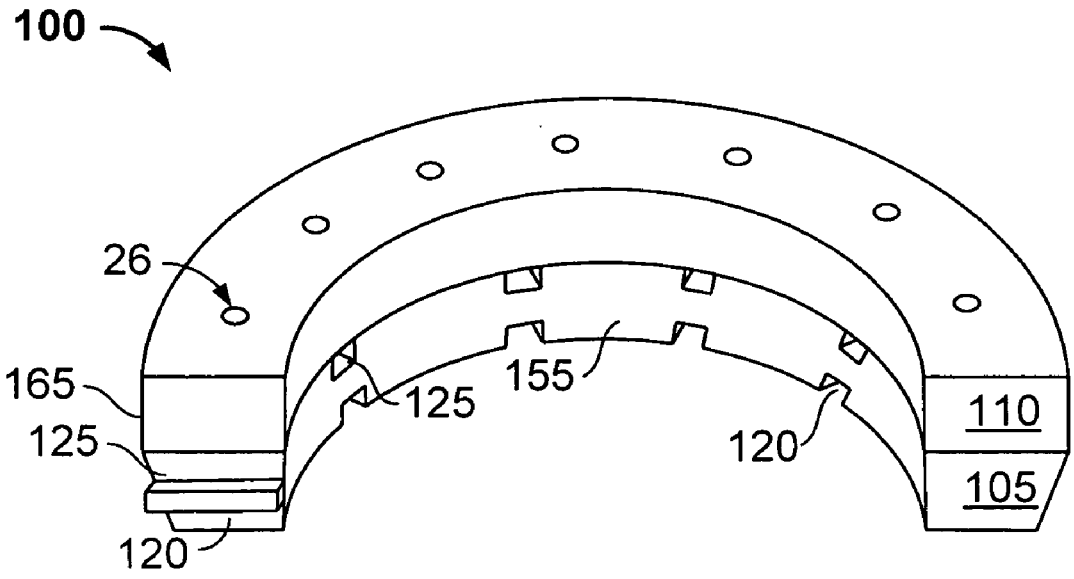
FIG. 6 is a perspective, partially cross-sectional view of a composite retaining ring.

Various ways of attaching the upper ring 110 and lower ring 105 can be implemented. One way of attaching the two rings is with an adhesive layer in the interface 215 between the two rings (as shown in FIG. 4). The adhesive layer can be a two-part slow-curing epoxy. Slow curing generally indicates that the epoxy takes on the order of several hours to several days to set. However, the epoxy curing cycle can be shortened with elevated temperature. The epoxy may be Magnobond-6375™, available from Magnolia Plastics of Chamblee, Ga. Alternatively, the epoxy can be a fast curing epoxy.

Instead of being adhesively attached, the lower ring 105 can be attached with fasteners, such as screws, or press-fit to the upper ring 110. However, an adhesive layer can potentially provide the ring with at least one benefit. An adhesive layer between the two rings at the inner and outer diameters prevents trapping of slurry in the retaining ring 100. During polishing, the friction between the polishing pad and the retaining ring 100 creates a side load which can skew the lower ring 105. This action can tend to pull the lower ring 105 away from the upper ring 110, creating a gap between the two rings in which slurry can accumulate and dry. However, if there is an adhesive layer between the upper and lower rings, the adhesive layer can prevent the slurry from entering the gap between the two rings. This can prevent slurry accumulation in the retaining ring 100 and thereby potentially reduce defects.

Figure 7:
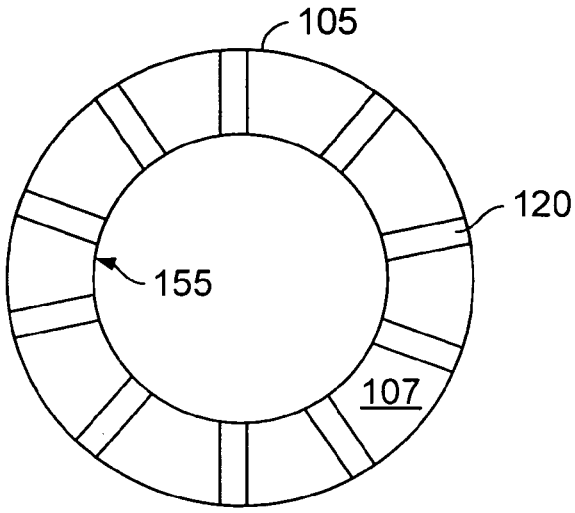
FIGS. 7–11 show a lower surface of a retaining ring.
Figure 8:
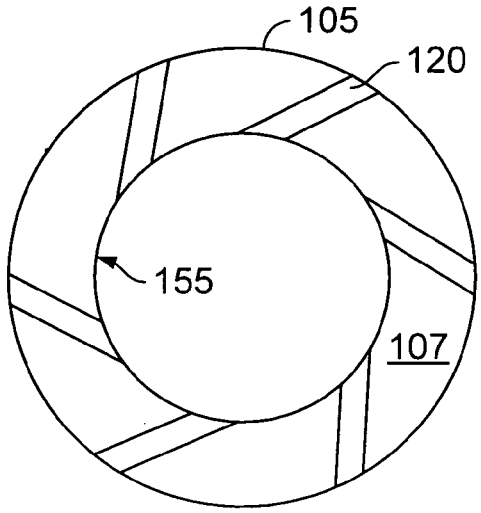
Figure 9:
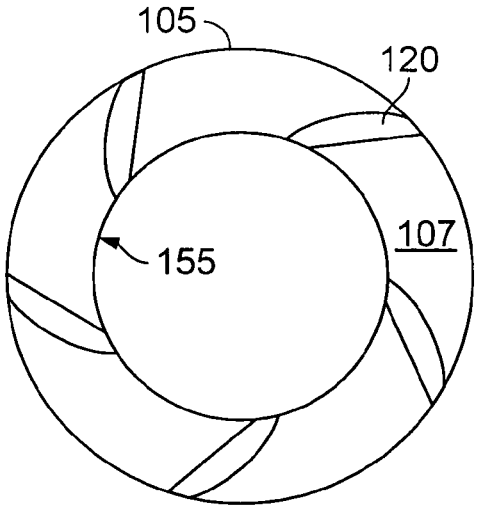
Figure 10:
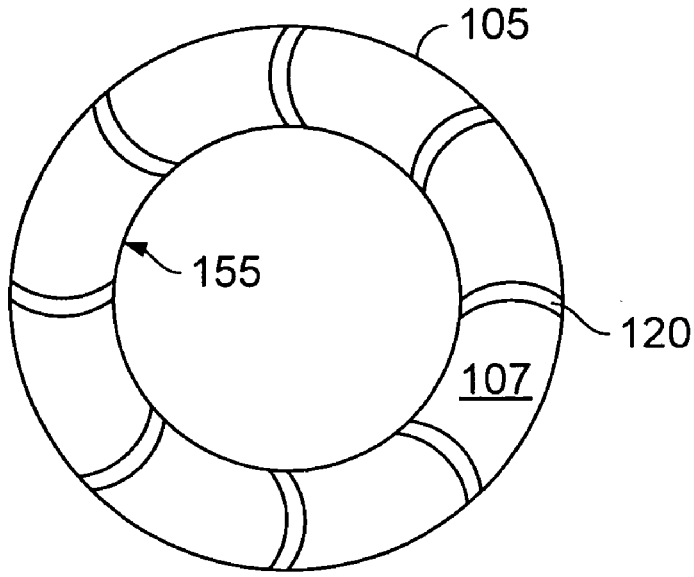
Figure 11:
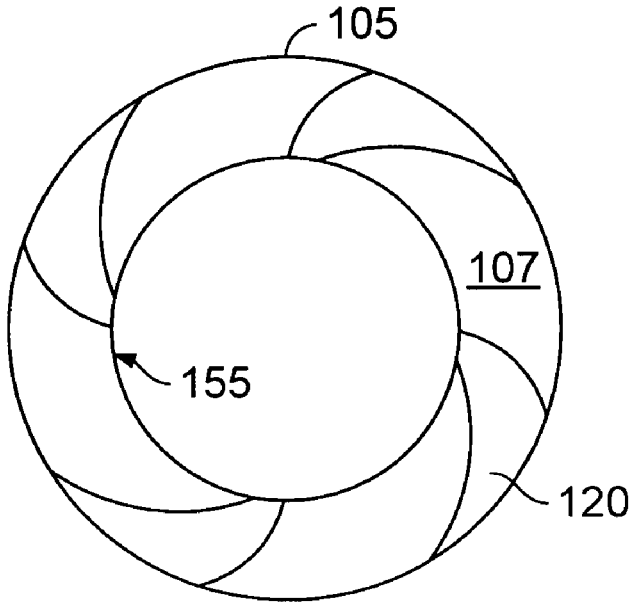

Referring to FIG. 7–11, the main portion of the lower surface 107 of the lower ring 105 is substantially flat. The lower surface 107 includes one or more recesses, channels or grooves 120. The grooves 120 extend from the inner diameter 155 of the retaining ring 100 to the outer diameter 165. The grooves 120 guide slurry from outside of the retaining ring 100 to the outer edge of the substrate. As shown in FIG. 7, the grooves 120 can follow a straight path along a radial axis from the inner diameter 155 to the outer diameter 165. The grooves 120 can be parallel to or at an acute angle to the radial axes that intersect the grooves 120. As shown in FIG. 8, the grooves 120 can follow a straight path, but be oriented at an acute angle to a radial axis of the lower ring 105 that intersects the groove 120. Referring to FIG. 9, one edge of the groove 120 can be curved while the other can be straight. Referring to FIG. 10, the grooves 120 can follow a curved path such that both edges are curved and form grooves with uniform widths from the inner to outer diameter, or are shaped as arc segments. Alternatively, as shown in FIG. 11, the grooves 120 can follow a curved path and taper from the inner diameter 155 to the outer diameter 165 or from the outer diameter 165 to the inner diameter 155. Any combination of groove shapes can exist on a single retaining ring.

Figure 12:
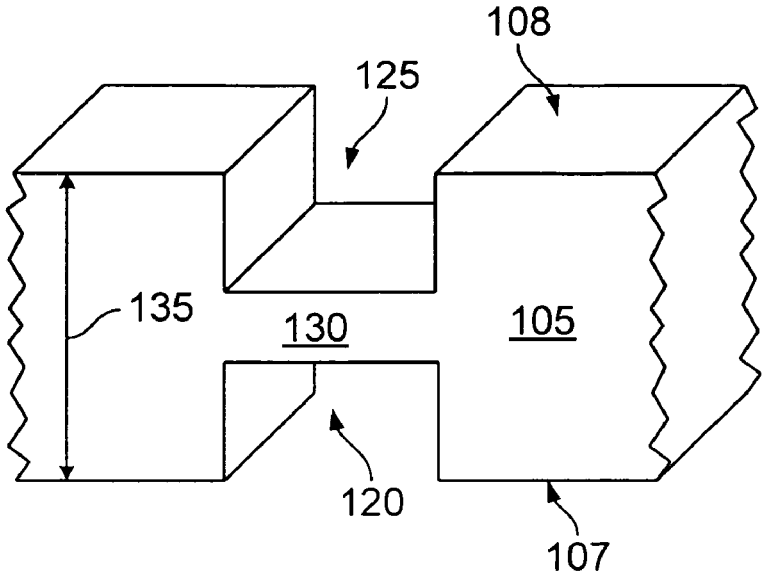
FIG. 12 shows a partial cross-sectional view of one portion of a retaining ring.
Figure 13:
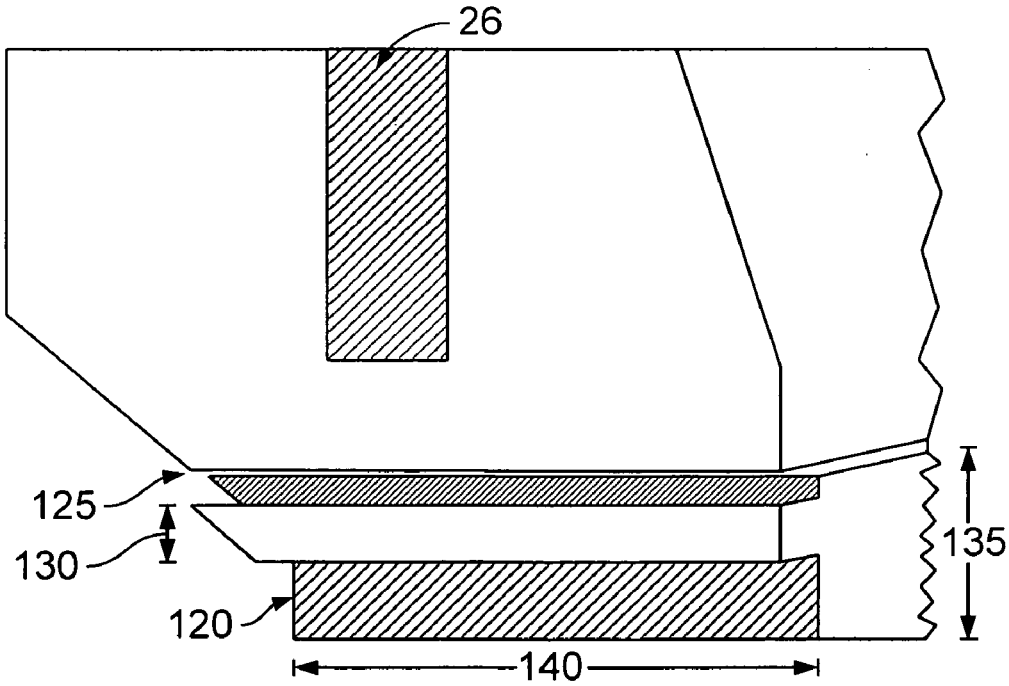
FIG. 13 shows a partial cross-sectional view of a retaining ring.

Referring to FIGS. 12 and 13, the lower ring 105 can also have channels, recesses or grooves 125 formed in the upper surface 108. The grooves 125 in the upper surface 108 can match or be formed in regions corresponding to the grooves 120 on the lower surface 107. In particular, the grooves 125 in the upper surface 108 can be vertically aligned with the grooves 120 in the lower surface 107. As such, the side walls of the grooves 120, 125 can be substantially aligned with one another. As shown in FIG. 12, a side view of the grooved portion has an H-shaped profile. A thin region 130 of material forming a bridge between two thick regions 135 and having a thickness of about between about 20 and 150 mils, such as between about 20 and 80 mils, is between the grooves 120, 125. The thick region 135 can have a thickness of about 100 to 500 mils, such as between about 150 and 400 mils, and is located in the non-grooved portions of the lower ring 105. The thin region 130 can be between about 5% and 80% the thickness of the thick region 135. The thin region 130 can have a width to thickness ratio of between about 1:1 and 10:1. An adhesive can fill the upper grooves 125, preventing slurry from entering or becoming trapped between the upper 110 and lower rings 105. Alternatively, a void can be between the grooves 125 and the upper ring 110.

Although the lower and upper grooves 120, 125 are shown with the same lateral width, the grooves can be formed with different widths. In one embodiment, the upper grooves 125 are wider than the lower grooves 120. In another embodiment, the lower grooves 120 are wider than the upper grooves 125. Although the grooves can be placed so that they are substantially vertically overlapping, precise alignment of the side walls of the grooves over one another is not required. Moreover, the shape of the upper grooves 125 need not be the same as the shape of the lower grooves 120. In some implementations, not all grooves 120 have matching upper grooves 125. The lower ring 105 can be sufficiently flexible with only a some of the lower grooves 120 having matching upper grooves 125. In one embodiment, the grooves 120 in the lower surface 107 can have sloping walls while the grooves 125 in the upper surface 108 can have walls that are perpendicular to the upper surface 108. In one embodiment, the thick regions 135 are wider than the thin regions 130. In another embodiment, the thin and thick regions 130, 135 have substantially the same width. The thin regions 130 can be shaped as thin arc segments. Thick arc segments are between the thin arc segments. The upper grooves 125 and lower grooves 120 can have the same depth (FIG. 12) or different depths (FIG. 13). Either the upper groove 125 or the lower groove 120 can be the deeper of the two grooves.

Forming a matching groove 125 on the upper surface 108 of the lower ring 105 to a groove 120 on the lower surface 107 forms a thin region 130 that has a higher-degree of flexibility than the thick region 135. The thin regions 130 increase the overall flexibility of the lower ring 105.

The lower ring 105 can be formed by injection molding a selected plastic material into a mold having the desired groove pattern. Alternatively, the lower ring 105 can be formed as a blank with flat, groove-free upper and lower surfaces. Grooves can then be formed in the upper and lower surfaces by machining, cutting, or grinding. The grooves 120, 125 can have a cross-section that is substantially squared off in the corners. Alternatively, the grooves 120, 125 can have a rounded profile, so that a cross-section has a u-shape.

As the retaining ring 100 is used to polish a substrate, a relative motion between the retaining ring 100 and a polishing surface is created. This motion can create internal stress in the lower ring 105. Continuous internal stress can eventually cause delamination of the retaining ring 100, that is, the upper portion 110 can pull away from the lower portion 105. Increasing the ratio between the cross-sectional width 140 of the ring and the height of the retaining ring 100 is one method of reducing the internal stress and reducing cupping force within the ring. Forming a matching groove on the upper surface 108 of the lower ring 105 further reduces the thickness of one or more portions of the ring. This aligning of the grooves further reduces the internal stress of the retaining ring 100.

Both reducing the thickness of the lower ring and forming matching grooves in the upper and lower surfaces of the ring increases the flexibility of the lower ring. Due to the presence of the thin sections, the thick sections of the ring can twist independently. The lower ring with matching grooves can have the ability to twist when external stress is placed on the ring, such as when the lower portion is being attached to the upper portion. The lower ring can be machined prior to use. Machining can correct orientation of the bottom surface of the ring so that it is orthogonal to the central axis of the retaining ring. When the retaining ring is in use, that is, when a substrate is being polished, and when the retaining ring is being machined, the ring can twist so that any distorting forces or localized stress on the ring is not transferred across the ring, but is only applied to a small portion of the ring, e.g., the thick portion between any two adjacent thin sections. This allows the ring to bend in only a select area of the retaining ring. Also, when the retaining ring is being machined, the ability of the lower ring to bend or twist enables the retaining ring to be machined with little to no distortion of the bottom surface.

When less internal stress builds up within the lower ring, the retaining ring can have a longer working life than a conventional retaining ring because the ring is less apt to delaminate or become deformed along the bottom surface. Forming the lower ring out of injection molded plastic tends to increase the likelihood of internal stress building up within the ring during use. When the lower ring is formed, the material can be selected based on a number of factors, such as lifespan, wear resistively, ability to achieve desired flatness during or after molding, propensity for internal stress build-up or ability to reduce imperfections in the ring. If the retaining ring is formed so that less internal stress builds up within the ring during polishing, the selection of the material from which the lower ring is formed need not be based on whether the material is susceptible to internal stress build up.

A number of embodiments of the invention have been described. Nevertheless, it will be understood that various modifications may be made without departing from the spirit and scope of the invention. The grooves described herein have a shape with substantially straight Accordingly, other embodiments are within the scope of the following claims.

What is claimed is:

1. A substrate retaining ring for use in chemical mechanical polishing of a substrate, comprising:

an upper ring having a lower surface; and a lower ring having a lower surface and an upper surface, the upper surface adjacent to the lower surface of the upper ring, wherein the lower surface of the lower ring has a plurality of grooves and the upper surface has a plurality of grooves that are substantially vertically overlapping with the plurality of grooves in the lower surface of the lower ring.

2. The retaining ring of claim 1, wherein the grooves in the lower surface extend from an inner diameter of the lower ring to an outer diameter of the lower ring.

3. The retaining ring of claim 1, wherein the grooves in the upper surface extend from an inner diameter of the lower ring to an outer diameter of the lower ring.

4. The retaining ring of claim 1 wherein a location of each groove in the upper surface corresponds to a location of a groove of the plurality of grooves in the lower surface.

5. The retaining ring of claim 1, wherein the grooves are arc shaped.

6. The retaining ring of claim 1, wherein the grooves are linear.

7. The retaining ring of claim 1 wherein one edge of each groove is straight and the opposing edge is curved.

8. The retaining ring of claim 1, wherein the grooves are not parallel with a radius of the retaining ring.

9. The retaining ring of claim 1, wherein a portion between the grooves has a width to thickness ratio between about 1:1 and 10:1.

10. The retaining ring of claim 1, wherein the grooves in the upper surface have a u-shaped cross-section, where the side walls are substantially perpendicular to one another.

11. The retaining ring of claim 1, wherein the lower ring is formed of carbon-filled PEEK.

12. A system for chemically mechanically polishing a substrate, comprising:

a carrier head including:

a substrate backing member; and a retaining ring according to claim 1; and a polishing surface support, wherein the retaining ring is brought near the polishing surface support during substrate polishing.

13. A carrier head, comprising:

a substrate backing member having a substrate contacting surface; and a retaining ring according to claim 1 surrounding the substrate contacting surface.

14. A portion of a substrate retaining ring for use in chemical mechanical polishing of substrates, comprising:

a ring having an upper surface and a lower surface, wherein the upper surface has a plurality of upper surface grooves and the lower surface has a plurality of lower surface grooves and at least one of the upper surface grooves is substantially vertically overlapping at least one of the lower surface grooves.

* * * * *